US011384996B2

(12) United States Patent
Nakamura et al.

(10) Patent No.: US 11,384,996 B2
(45) Date of Patent: Jul. 12, 2022

(54) HEAT EXCHANGER AND REFRIGERATION CYCLE APPARATUS

(71) Applicant: Mitsubishi Electric Corporation, Tokyo (JP)

(72) Inventors: Shin Nakamura, Tokyo (JP); Tsuyoshi Maeda, Tokyo (JP); Akira Ishibashi, Tokyo (JP); Tomoyuki Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 147 days.

(21) Appl. No.: 16/651,704

(22) PCT Filed: Oct. 16, 2017

(86) PCT No.: PCT/JP2017/037384
§ 371 (c)(1),
(2) Date: Mar. 27, 2020

(87) PCT Pub. No.: WO2019/077655
PCT Pub. Date: Apr. 25, 2019

(65) Prior Publication Data
US 2020/0256626 A1 Aug. 13, 2020

(51) Int. Cl.
*F28D 1/04* (2006.01)
*F28F 1/32* (2006.01)
(Continued)

(52) U.S. Cl.
CPC ..... *F28F 1/325* (2013.01); *F25B 39/02* (2013.01); *F28D 2021/0068* (2013.01);
(Continued)

(58) Field of Classification Search
CPC ..... F28F 1/325; F28F 1/32; F28F 1/02; F28F 1/022; F28F 17/00; F28F 17/005;
(Continued)

(56) References Cited

U.S. PATENT DOCUMENTS

2014/0338876 A1* 11/2014 Hokazono ..... F28F 1/126 165/181
2018/0106563 A1 4/2018 Nakamura et al.
(Continued)

FOREIGN PATENT DOCUMENTS

EP 2803930 A1 11/2014
JP H10-062086 A 3/1998
(Continued)

OTHER PUBLICATIONS

Attached pdf file is translation of foreign reference JP2015117876A. (Year: 2015).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A heat exchanger includes: a plate-like fin having one end and an other end in a first direction; and a first heat transfer tube and a second heat transfer tube that each extends through the fin and that are adjacent to each other in a second direction. A portion to which the fin and the first heat transfer tube are connected and a clearance portion that separates between the fin and the first heat transfer tube are disposed between the fin and the first heat transfer tube. The clearance portion is disposed at one end side in the first direction relative to an imaginary center line that passes through a center of the first heat transfer tube in a long side direction and that extends along a short side direction.

19 Claims, 6 Drawing Sheets

(51) Int. Cl.

| | |
|---|---|
| ***F25B 39/02*** | (2006.01) |
| *F28D 21/00* | (2006.01) |
| *F28F 1/02* | (2006.01) |
| *F28F 17/00* | (2006.01) |

(52) U.S. Cl.
CPC ..... *F28F 1/02* (2013.01); *F28F 17/005* (2013.01); *F28F 2215/12* (2013.01)

(58) Field of Classification Search
CPC ..... F28F 2215/12; F28F 2265/14; F28F 2275/04; F28B 9/08; F28D 1/05391; F28D 2021/0068; F28D 15/0233; F28D 15/0275
See application file for complete search history.

(56) References Cited

U.S. PATENT DOCUMENTS

| | | | |
|---|---|---|---|
| 2018/0120039 | A1 | 5/2018 | Nakamura et al. |
| 2018/0372429 | A1 | 12/2018 | Maeda et al. |

FOREIGN PATENT DOCUMENTS

| | | | | |
|---|---|---|---|---|
| JP | 3766030 | B2 | 7/2003 | |
| JP | 2008-241057 | A | 10/2008 | |
| JP | 2008241057 | A * | 10/2008 | ..... F28D 1/05366 |
| JP | 2014-238204 | A | 12/2014 | |
| JP | 2015-117876 | A | 6/2015 | |
| JP | 2015117876 | A * | 6/2015 | |
| WO | 2016/194043 | A1 | 12/2016 | |
| WO | 2016/194088 | A1 | 12/2016 | |
| WO | 2017/126019 | A1 | 7/2017 | |

OTHER PUBLICATIONS

Attached pdf file is translation of foreign reference JP2008241057A (Year: 2008).*

Pdf file is translation of foreign reference JP2015117876A (Year: 2015).*

Japanese Office Action dated Jan. 26, 2021, issued in corresponding Japanese Patent Application No. 2019-548800 (and English Machine Translation).

International Search Report of the International Searching Authority dated Jan. 16, 2018 for the corresponding International application No. PCT/JP2017/037384 (and English translation).

Extended European Search Report dated Oct. 23, 2020 issued in the corresponding EP application No. 17928887.3.

* cited by examiner

HEAT EXCHANGER AND REFRIGERATION CYCLE APPARATUS

CROSS REFERENCE TO RELATED APPLICATION

This application is a U.S. national stage application of International Application PCT/JP2017/037384, filed on Oct. 16, 2017, the contents of which are incorporated herein by reference.

TECHNICAL FIELD

The present invention relates to a heat exchanger and a refrigeration cycle apparatus, particularly, a fin and tube type heat exchanger and a refrigeration cycle apparatus including the fin and tube type heat exchanger.

BACKGROUND

Conventionally, there has been known a fin and tube type heat exchanger including: a plurality of plate-like fins arranged at a predetermined fin pitch interval; and a plurality of heat transfer tubes extending through the fins along a direction in which the plurality of fins are arranged.

In the fin and tube type heat exchanger, the plurality of heat transfer tubes are inserted in openings provided in the plurality of fins, such as through holes or notches. Accordingly, the plurality of heat transfer tubes extend through the fins. An end portion of each heat transfer tube is connected to a distribution tube or a header. Accordingly, a target heat exchanging fluid such as water or refrigerant flows in each heat transfer tube, and heat is exchanged between the target heat exchanging fluid and a heat exchanging fluid such as air flowing between the plurality of fins.

A conventional fin and tube type heat exchanger has been known in which each heat transfer tube has a flat cross sectional shape perpendicular to the extending direction of the heat transfer tube. With the heat transfer tube having such a flat cross sectional shape, separation of airflow can be reduced and airflow resistance can be smaller than that in a heat transfer tube having a circular cross sectional shape. Hence, the heat transfer tubes having such flat cross sectional shapes can be mounted in high density. A heat exchanger in which the heat transfer tubes each having a flat cross sectional shape are mounted in high density has an improved balance between heat transfer performance and airflow performance.

On the other hand, when the heat exchanger is operated as an evaporator in an environment in which an outdoor air temperature is, for example, below a freezing point, a water content in the heat exchanging fluid is condensed around the heat transfer tubes to result in frost. Such frost is melted into water droplets by a defrosting operation; however, the water droplets need to be appropriately discharged from around the heat transfer tubes in order to prevent accumulation and freezing of the water droplets around the heat transfer tubes.

In order to reduce a defrosting time by appropriately discharging water droplets from around heat transfer tubes, Japanese Patent Laying-Open No. 10-62086 discloses a fin and tube type heat exchanger in which a clearance for flow of water is formed between a lower surface of a heat transfer tube having a flat shape and an insertion hole in which the heat transfer tube is inserted.

PATENT LITERATURE

PTL 1: Japanese Patent Laying-Open No. 10-62086

However, in the conventional fin and tube type heat exchanger, a portion between adjacent heat transfer tubes cannot be sufficiently prevented from being blocked by frost, disadvantageously.

In the fin and tube type heat exchanger, the absolute humidity of the heat exchanging fluid flowing between the adjacent heat transfer tubes becomes smaller from a windward side to a leeward side in a flow direction. A temperature boundary layer formed between the adjacent heat transfer tubes becomes thicker from the windward side to the leeward side. Hence, in the conventional fin and tube type heat exchanger described in Japanese Patent Laying-Open No. 10-62086, frost is more likely to be formed at the windward side at which the absolute humidity of the heat exchanging fluid is large and the temperature boundary layer is thin, than at the leeward side at which the absolute humidity of the heat exchanging fluid is small and the temperature boundary layer is thick.

Particularly, when the heat transfer tubes are mounted in high density, a flow path for the heat exchanging fluid between the adjacent heat transfer tubes is likely to be blocked by frost grown at the windward side, disadvantageously. When the flow path for the heat exchanging fluid is blocked by frost, performance of the refrigeration cycle apparatus during a heating operation is decreased.

SUMMARY

A main object of the present invention is to provide a heat exchanger and a refrigeration cycle apparatus to effectively suppress a flow path for a heat exchanging fluid from being blocked by frost as compared with a conventional fin and tube type heat exchanger.

A heat exchanger according to the present invention includes: a plate-like fin having one end and an other end in a first direction; and a first heat transfer tube and a second heat transfer tube that each extend through the fin and that are adjacent to each other in a second direction crossing the first direction. An outer shape of each of the first heat transfer tube and the second heat transfer tube in a cross section perpendicular to an extending direction of each of the first heat transfer tube and the second heat transfer tube is a flat shape having a long side direction and a short side direction. A first end portion of the first heat transfer tube located at the one end side is disposed at one side in the second direction relative to a second end portion of the first heat transfer tube located at the other end side. A third end portion of the second heat transfer tube located at the one end side is disposed at the one side in the second direction relative to a fourth end portion of the second heat transfer tube located at the other end side. A portion to which the fin and at least one of the first heat transfer tube and the second heat transfer tube are connected, and at least one clearance portion that separates between the fin and the at least one of the first heat transfer tube and the second heat transfer tube are disposed between the fin and the at least one of the first heat transfer tube and the second heat transfer tube. The at least one clearance portion is disposed at the one end side in the first direction relative to an imaginary center line that passes through a center of the first heat transfer tube in the long side direction and that extends along the short side direction.

According to the present invention, by the clearance portion disposed to overlap with the first imaginary line, the temperature of the fin located on the first imaginary line during an operation as an evaporator is suppressed from being decreased as compared with a conventional heat exchanger. Hence, according to the present invention, there can be provided a heat exchanger and a refrigeration cycle apparatus to effectively suppress a flow path for a heat exchanging fluid from being blocked by frost.

DETAILED DESCRIPTION

Figure 1:
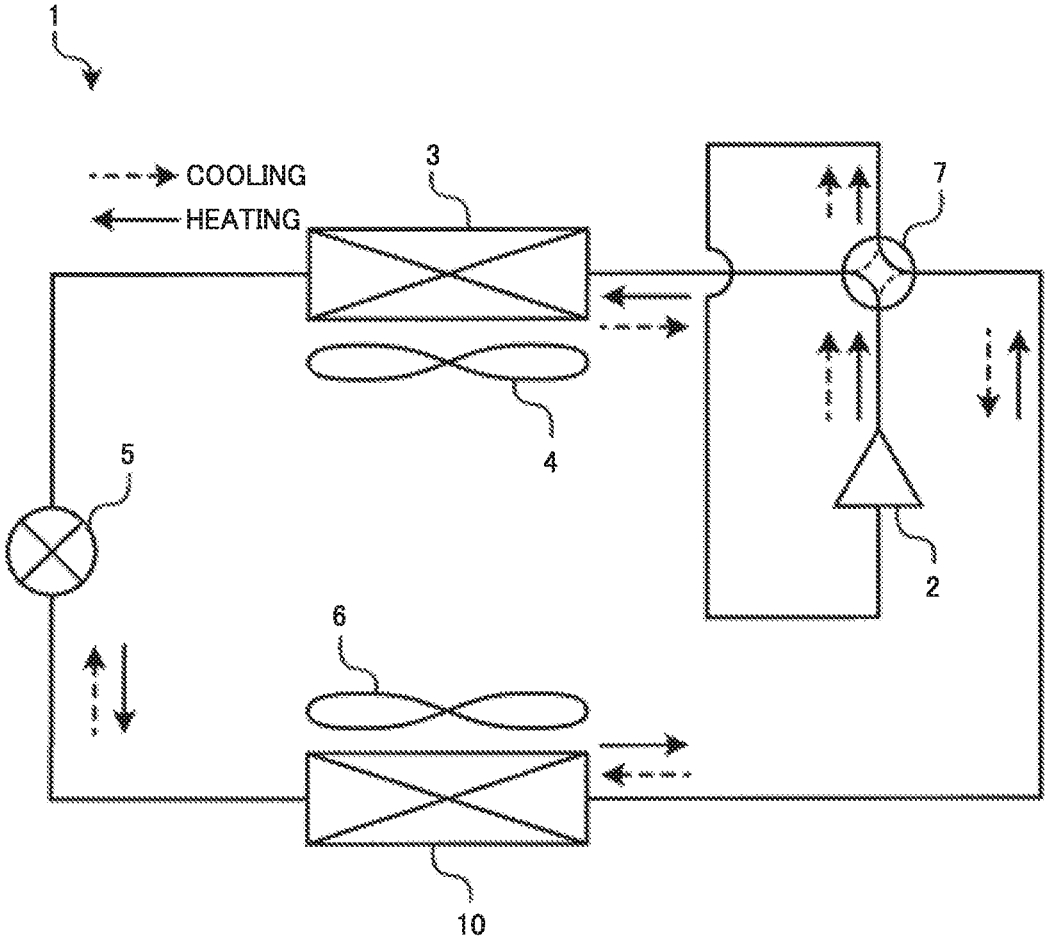
FIG. 1 shows an exemplary refrigerant circuit of a refrigeration cycle apparatus according to a first embodiment.

The following describes embodiments of the present invention with reference to figures. It should be noted that in the below-described figures, the same or corresponding portions are given the same reference characters and are not described repeatedly.

First Embodiment

<Configuration of Refrigeration Cycle Apparatus>

With reference to FIG. 1, a refrigeration cycle apparatus 1 according to a first embodiment will be described. As shown in FIG. 1, refrigeration cycle apparatus 1 includes a compressor 2, an indoor heat exchanger 3, an indoor fan 4, a throttle device 5, an outdoor heat exchanger 10, an outdoor fan 6, and a four-way valve 7. For example, compressor 2, outdoor heat exchanger 10, throttle device 5, and four-way valve 7 are provided in an outdoor unit, and indoor heat exchanger 3 is provided in an indoor unit.

Compressor 2, indoor heat exchanger 3, throttle device 5, outdoor heat exchanger 10, and four-way valve 7 constitute a refrigerant circuit in which refrigerant can circulate. In refrigeration cycle apparatus 1, a refrigeration cycle is performed in which the refrigerant circulates with a phase change in the refrigerant circuit.

Compressor 2 compresses the refrigerant. Compressor 2 is a rotary compressor, a scroll compressor, a screw compressor, a reciprocating compressor, or the like, for example.

Indoor heat exchanger 3 functions as a condenser during a heating operation, and functions as an evaporator during a cooling operation. Indoor heat exchanger 3 is a fin and tube type heat exchanger, a micro channel heat exchanger, a shell and tube type heat exchanger, a heat pipe type heat exchanger, a double-tube type heat exchanger, a plate heat exchanger, or the like, for example.

Throttle device 5 expands and decompresses the refrigerant. Throttle device 5 is an electrically powered expansion valve or the like that can adjust a flow rate of the refrigerant, for example. It should be noted that examples of throttle device 5 may include not only the electrically powered expansion valve but also a mechanical expansion valve employing a diaphragm for a pressure receiving portion, a capillary tube, or the like.

Outdoor heat exchanger 10 functions as an evaporator during the heating operation, and functions as a condenser during the cooling operation. Outdoor heat exchanger 10 is a fin and tube type heat exchanger. Details of outdoor heat exchanger 10 will be described later.

Four-way valve 7 can switch a flow path for the refrigerant in refrigeration cycle apparatus 1. During the heating operation, four-way valve 7 is switched to connect a discharge port of compressor 2 to indoor heat exchanger 3, and connect a suction port of compressor 2 to outdoor heat exchanger 10. Moreover, during the cooling operation and a dehumidification operation, four-way valve 7 is switched to connect the discharge port of compressor 2 to outdoor heat exchanger 10 and connect the suction port of compressor 2 to indoor heat exchanger 3.

Indoor fan 4 is attached to indoor heat exchanger 3 and supplies indoor air to indoor heat exchanger 3 as a heat exchanging fluid. Outdoor fan 6 is attached to outdoor heat exchanger 10 and supplies outdoor air to outdoor heat exchanger 10.

<Configuration of Heat Exchanger>

Next, heat exchanger 10 will be described with reference to FIG. 2 and FIG. 3.

It should be noted that in the description below, for ease of description, the x direction represents a direction in which a short side of each of a plurality of fins 30 included in heat exchanger 10 extends, the y direction represents a direction in which each of a plurality of heat transfer tubes 20 included in heat exchanger 10 extends, and the z direction (second direction) represents a direction in which a long side of each of the plurality of fins 30 included in heat exchanger 10 extends and in which the plurality of heat transfer tubes 20 are arranged and disposed to be separated from each other. In refrigeration cycle apparatus 1, heat exchanger 10 is disposed such that the x direction is along the flow direction of the heat exchanging fluid supplied from outdoor fan 6 shown in FIG. 1 and such that the z direction is along a gravity direction.

Figure 2:
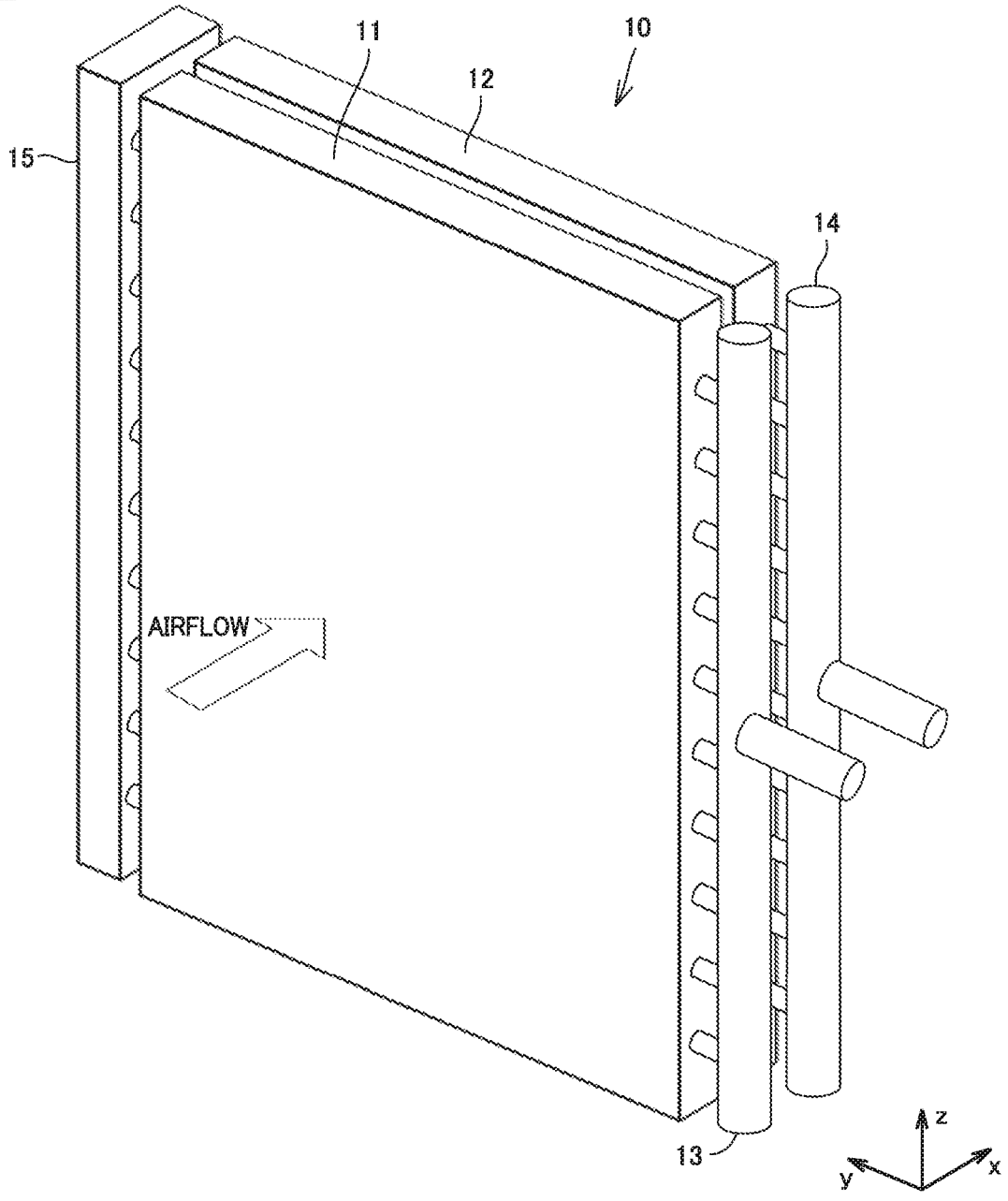
FIG. 2 is a perspective view showing an exemplary heat exchanger shown in FIG. 1.

As shown in FIG. 2, heat exchanger 10 is a heat exchanger having a two-column structure, for example. Heat exchanger 10 includes: a first heat exchanger 11 disposed at a windward side in the x direction; and a second heat exchanger 12 disposed at a leeward side in the x direction. Each of first heat exchanger 11 and second heat exchanger 12 is configured as a fin and tube type heat exchanger. Each of first heat exchanger 11 and second heat exchanger 12 includes: a plurality of heat transfer tubes disposed to be separated from each other in the gravity direction; and a plurality of fins through which each of the plurality of heat transfer tubes extends. It should be noted that depending on a heat exchange load imposed on heat exchanger 10, heat exchanger 10 may be configured as a heat exchanger having a one-column structure, i.e., having one of first heat exchanger 11 and second heat exchanger 12.

As shown in FIG. 2, one end of each heat transfer tube of first heat exchanger 11 is connected to first header portion 13. One end of each heat transfer tube of second heat exchanger 12 is connected to second header portion 14. The other end of the heat transfer tube of first heat exchanger 11 and the other end of the heat transfer tube of second heat exchanger 12 are connected to an inter-column connection member 15.

First header portion 13 is provided to distribute externally supplied refrigerant to each of the heat transfer tubes of first heat exchanger 11. Second header portion 14 is provided to distribute externally supplied refrigerant to each of the heat transfer tubes of second heat exchanger 12. Accordingly, heat exchanger 10 has a refrigerant flow path in which first header portion 13, each heat transfer tube of first heat exchanger 11, inter-column connection member 15, each heat transfer tube of second heat exchanger 12, and second header portion 14 are connected in this order.

First heat exchanger 11 and second heat exchanger 12 have equivalent configurations, for example. In the description below, the configuration of first heat exchanger 11 will be described on behalf of first heat exchanger 11 and second heat exchanger 12.

Figure 3:
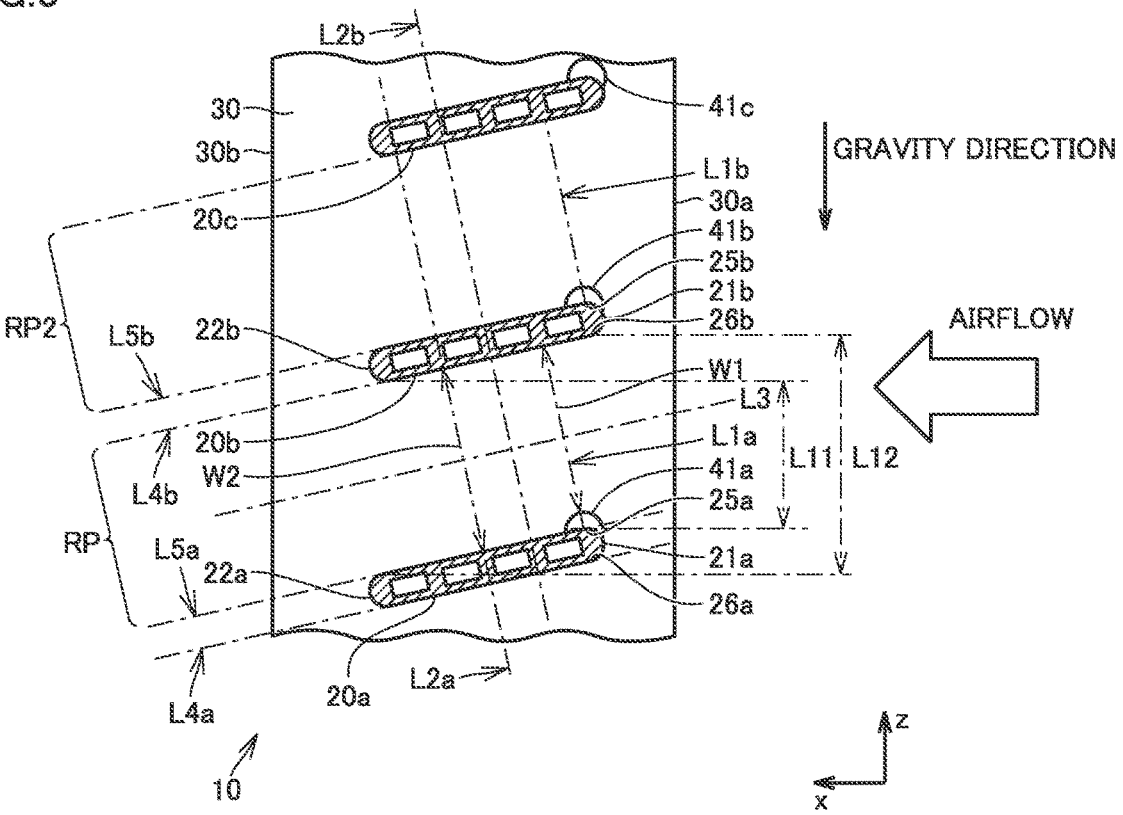
FIG. 3 is a partial cross sectional view of the heat exchanger shown in FIG. 2.
Figure 4:
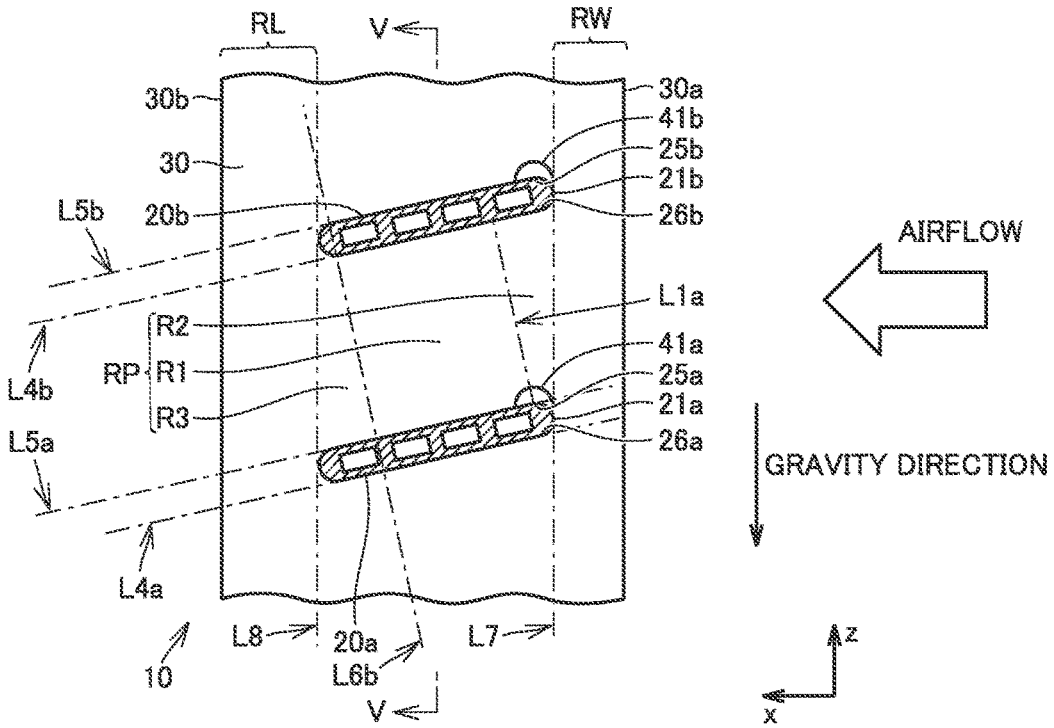
FIG. 4 is a partial cross sectional view of the heat exchanger shown in FIG. 2.

As shown in FIG. 3 and FIG. 4, first heat exchanger 11 includes the plurality of heat transfer tubes 20 and the plurality of fins 30. Each of the plurality of heat transfer tubes 20 extends along the y direction. The plurality of heat transfer tubes 20 include a first heat transfer tube 20*a* and a second heat transfer tube 20*b* that are adjacent to each other in the z direction. First heat transfer tube 20*a* is disposed below second heat transfer tube 20*b*.

Each of the plurality of fins 30 is provided in a plate-like form. Each of the plurality of fins 30 has a surface that is perpendicular to the y direction and that has a rectangular outer shape, for example. When seen in the y direction, the short side of fin 30 is along the x direction, and the long side of fin 30 is along the z direction. Fin 30 has one end 30*a* and an other end 30*b* in the x direction. One end 30*a* is disposed at the windward side in the flow direction of the heat exchanging fluid, and other end 30*b* is disposed at the leeward side in the flow direction of the heat exchanging fluid. The plurality of fins 30 are provided with: through holes through which respective ones of the plurality of heat transfer tubes 20 extend; and clearance portions 41*a*, 41*b* continuous to the through holes (details will be described later). It should be noted that first heat transfer tube 20*a* and second heat transfer tube 20*b* shown in FIG. 3 are any two heat transfer tubes that are adjacent to each other in the gravity direction among the plurality of heat transfer tubes 20 in first heat exchanger 11. Fin 30 shown in FIG. 3 is any one fin of the plurality of fins 30 in first heat exchanger 11.

As shown in FIG. 3, the outer shape of each of first heat transfer tube 20*a* and second heat transfer tube 20*b* in the cross section perpendicular to the y direction is a flat shape having a long side direction and a short side direction orthogonal to the long side direction. Each of first heat transfer tube 20*a* and second heat transfer tube 20*b* has an upper flat surface and a lower flat surface disposed to be separated from each other in the short side direction. The upper flat surfaces and lower flat surfaces of first heat transfer tube 20*a* and second heat transfer tube 20*b* are disposed in parallel, for example. Each of first heat transfer tube 20*a* and second heat transfer tube 20*b* further has a first surface and a second surface, the first surface connecting the upper flat surface to the lower flat surface at the windward side, the second surface connecting the upper flat surface to the lower flat surface at the leeward side. In each of first heat transfer tube 20*a* and second heat transfer tube 20*b*, a plurality of flow paths for refrigerant to flow are disposed side by side in the long side direction of the flat shape, for example.

In the description below, for ease of description, a windward side end portion 21*a* (first end portion) represents an end portion of first heat transfer tube 20*a* located at the windward side (the one end 30*a* side of fin 30), and a leeward side end portion 22*a* (second end portion) represents an end portion of first heat transfer tube 20*a* located at the leeward side (the other end 30*b* side of fin 30). A first boundary portion 25*a* represents a boundary portion between the upper flat surface and first surface of first heat transfer tube 20*a*, and a second boundary portion 26*a* represents a boundary portion between the lower flat surface and first surface of first heat transfer tube 20*a*. A windward side end portion 21*b* (third end portion) represents an end portion of second heat transfer tube 20*b* located at the windward side, and a leeward side end portion 22*b* (fourth end portion) represents an end portion of second heat transfer tube 20*b* located at the leeward side. A third boundary portion 25*b* represents a boundary portion between the upper flat surface and first surface of second heat transfer tube 20*b*, and a fourth boundary portion 26*b* represents a boundary portion between the lower flat surface and first surface of second heat transfer tube 20*b*.

As shown in FIG. 3 and FIG. 4, windward side end portion 21*a* is disposed at the upper side relative to leeward side end portion 22*a*. Windward side end portion 21*b* is disposed at the upper side relative to leeward side end portion 22*b*. In other words, each of first heat transfer tube 20*a* and second heat transfer tube 20*b* is inclined downward in the gravity direction from the windward side to the leeward side in the flowing direction. From a different viewpoint, it can be said that a distance (seen as L11) in the z direction between windward side end portion 21*a* of first heat transfer tube 20*a* and leeward side end portions 22*b* of second heat transfer tube 20*b* is shorter than a distance (seen as L12) in the z direction between leeward side end portion 22*a* of first heat transfer tube 20*a* and windward side end portion 21*b* of second heat transfer tube 20*b*.

As shown in FIG. 3 and FIG. 4, in the cross section perpendicular to the y direction, each long side direction of first heat transfer tube 20*a* and second heat transfer tube 20*b* is disposed to form a smaller angle with respect to the x direction than an angle formed with respect to the z direction. In the cross section perpendicular to the y direction, each short side direction of first heat transfer tube 20*a* and second heat transfer tube 20*b* is disposed to form a larger angle with respect to the x direction than an angle formed with respect to the z direction. In the cross section perpendicular to the y direction, each long side direction of first heat transfer tube 20*a* and second heat transfer tube 20*b* forms an angle of less than or equal to 20° with respect to the x direction, for example.

As shown in FIG. 3 and FIG. 4, windward side end portion 21*a* and windward side end portion 21*b* are disposed to overlap in the z direction. First boundary portion 25*a* and second boundary portion 26*a* are disposed to overlap in the short side direction. Third boundary portion 25*b* and fourth boundary portion 26*b* are disposed to overlap in the short side direction. Leeward side end portion 22*a* and leeward side end portion 22*b* are disposed to overlap in the z direction. First boundary portion 25*a* and third boundary portion 25*b* are disposed to overlap in the z direction.

Figure 5:
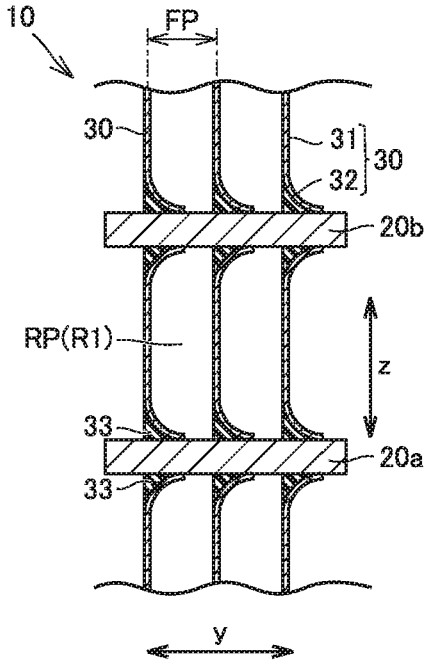
FIG. 5 is a partial cross sectional view when seen from a line segment V-V in FIG. 4.

As shown in FIG. 3, FIG. 4, and FIG. 5, first heat transfer tube 20*a* and second heat transfer tube 20*b* extend through each of of the plurality of fins 30. The plurality of fins 30 are disposed to be separated from each other at a predetermined interval FP (see FIG. 5) in the y direction.

As shown in FIG. 3, a first imaginary line segment 1*a* is defined to represent an imaginary line segment that extends along the short side direction, that passes through first boundary portion 25*a* and second boundary portion 26*a*, and that is located between first heat transfer tube 20*a* and second heat transfer tube 20*b*. An imaginary center line L2*a* is defined to represent an imaginary line that extends along the short side direction and that passes through the center of first heat transfer tube 20*a* in the long side direction. A second imaginary line segment L1*b* is defined to represent an imaginary line segment that extends along the short side direction, that passes through third boundary portion 25*b* and fourth boundary portion 26*b*, and that is located between third heat transfer tube 20*c* and second heat transfer tube 20*b*. Further, an imaginary line L3 is defined to represent an imaginary line that passes through the center between first heat transfer tube 20*a* and second heat transfer tube 20*b* in the short side direction and that extends along the long side direction. An imaginary line L4*b* is defined to represent an imaginary line obtained by extending the lower flat surface of second heat transfer tube 20*b*. An imaginary line L5*a* is defined to represent an imaginary line obtained by extending the upper flat surface of first heat transfer tube 20*a*. An imaginary line L5*b* is defined to represent an imaginary line obtained by extending the upper flat surface of second heat transfer tube 20*b*. An imaginary line L7 is defined to represent an imaginary line that connects windward side end portion 21*a* to windward side end portion 21*b*. An imaginary line L8 is defined to represent an imaginary line that connects leeward side end portion 22*a* to leeward side end portion 22*b*.

As shown in FIG. 4, an airflow path region RP is defined to represent a region which is located between first heat transfer tube 20*a* and second heat transfer tube 20*b* and in which the heat exchanging fluid flows along fin 30. In the y direction, airflow path region RP is disposed between imaginary line L7 that connects windward side end portion 21*a* to windward side end portion 21*b* and imaginary line L8 that connects leeward side end portion 22*a* to leeward side end portion 22*b*. A windward region RW is defined to represent a region that is disposed at the windward side relative to airflow path region RP, i.e., at the windward side relative to imaginary line L7 and that is continuous to airflow path region RP. A leeward region RL is defined to represent a region that is disposed at the leeward side relative to airflow path region RP, i.e., at the leeward side relative to imaginary line L8 and that is continuous to airflow path region RP. A second airflow path region RP2 is defined to represent a region which is disposed between second heat transfer tube 20*b* and third heat transfer tube 20*c* and in which the heat exchanging fluid flows. Airflow path region RP and second airflow path region RP2 are disposed with second heat transfer tube 20*b* being interposed therebetween.

As shown in FIG. 4, in airflow path region RP, a first region R1 is defined to represent a region in which first heat transfer tube 20*a* and second heat transfer tube 20*b* are connected in the shortest distance. First region R1 is a region disposed on fin 30 between imaginary line L5*a* obtained by extending the upper flat surface of first heat transfer tube 20*a* and imaginary line L4*b* obtained by extending the lower flat surface of second heat transfer tube 20*b* in the z direction, and between first imaginary line segment L1*a* and third imaginary line L6*b* in the flow direction. First region R1 has a rectangular shape. Further, in airflow path region RP, a second region R2 is defined to represent a region disposed between first region R1 and windward region RW, and a third region R3 is defined to represent a region disposed between first region R1 and leeward region RL.

As shown in FIG. 3, first imaginary line segment L1*a* is an imaginary line segment that connects between first heat transfer tube 20*a* and second heat transfer tube 20*b* in the shortest distance and that is drawn at the most windward side in the x direction. In other words, first imaginary line segment L1*a* is drawn at the most windward side on first region R1, and constitutes one side of first region R1. Second imaginary line segment L1*b* is an imaginary line segment that connects, in the shortest distance, between second heat transfer tube 20*b* and third heat transfer tube 20*c* disposed above second heat transfer tube 20*b* and adjacent to second heat transfer tube 20*b*. Second imaginary line segment L1*b* is an imaginary line segment drawn at the most windward side in the x direction. Imaginary center line L2*a* is an imaginary line that connects between first heat transfer tube 20*a* and second heat transfer tube 20*b* in the shortest distance and that is drawn at the leeward side relative to first imaginary line segment L1*a*. Imaginary center line L2*a* passes through the leeward side relative to the center of first region R1 in the long side direction. Each of the imaginary lines that connect between first heat transfer tube 20*a* and second heat transfer tube 20*b* in the shortest distance, such as first imaginary line segment L1*a* and imaginary center line L2*a*, is drawn on first region R1.

As shown in FIG. 3, in airflow path region RP, clearance portion 41*a* that separates between first heat transfer tube 20*a* and fin 30 is disposed at the windward side relative to imaginary center line L2*a*. Clearance portion 41*a* is disposed not to overlap with imaginary center line L2*a*. Clearance portion 41*a* is formed as a through hole extending through fin 30 in the y direction, for example. Clearance portion 41*a* may have any configuration as long as a heat path between first heat transfer tube 20*a* and fin 30 facing clearance portion 41*a* can be made longer than a heat path between first heat transfer tube 20*a* and fin 30 not facing clearance portion 41*a*. For example, clearance portion 41*a* may be configured as a portion depressed with respect to a plane perpendicular to the y direction in fin 30.

As shown in FIG. 3, clearance portion 41*b* is disposed at the windward side relative to imaginary center line L2*b* of second heat transfer tube 20*b*, for example. Clearance portion 41*b* is disposed not to overlap with imaginary center line L2*b* of second heat transfer tube 20*b*, for example.

As shown in FIG. 3, clearance portion 41*a* is disposed to overlap with first imaginary line segment L1*a*, for example. Clearance portion 41*a* faces a portion of each of the upper flat surface and first surface of first heat transfer tube 20*a*, for example. When seen in the y direction, clearance portion 41*a* is disposed to span first region R1 and second region R2, for example. That is, clearance portion 41*a* faces a portion of the upper flat surface of first heat transfer tube 20*a* located at the most windward side. It should be noted that when seen in the y direction, clearance portion 41*a* may be disposed to span first region R1, second region R2, and windward region RW, for example.

Although clearance portion 41*a* may have any planar shape when seen in the y direction, clearance portion 41*a* has a sector shape centering on a portion of first heat transfer tube 20*a* located on first imaginary line segment L1*a*, i.e., first boundary portion 25*a* as shown in FIG. 3, for example. The width of clearance portion 41*a* in the short side direction is the widest on first imaginary line segment L a, for example. The width of clearance portion 41*a* in the long side direction is the widest on imaginary line L5*a*, for example. In other words, the widest portion of clearance portion 41*a* in the long side direction is a portion of clearance portion 41*a* facing first heat transfer tube 20*a*, for example. The width of clearance portion 41*a* in the short side direction becomes gradually narrower as clearance portion 41*a* is further away from first imaginary line segment L1*a* in the long side direction, for example. The width of clearance portion 41*a* in the long side direction becomes gradually narrower as clearance portion 41*a* is further away from first heat transfer tube 20*a* in the short side direction, for example.

As shown in FIG. 3, since clearance portion 41*a* is disposed, a width W1 of fin 30 on first imaginary line segment L1*a* is shorter than width W2 of fin 30 on any imaginary line that connects between first heat transfer tube 20*a* and second heat transfer tube 20*b* in the shortest distance without clearance portion 41*a* being interposed therebetween in first region R1, such as imaginary center line L2*a*.

As shown in FIG. 3, width W1 of fin 30 on first imaginary line segment L1*a* is shorter than the width of fin 30 on any imaginary line that connects between first heat transfer tube 20*a* and second heat transfer tube 20*b* in the shortest distance in first region R1, such as an imaginary line that is located at the leeward side relative to first imaginary line segment L1*a* and that is drawn to overlap with clearance portion 41*a*.

As shown in FIG. 3, when seen in the y direction, the maximum width of clearance portion 41*a* is less than the width of first heat transfer tube 20*a* in the short side direction, for example. The length, in the long side direction, of a portion of the upper flat surface of first heat transfer tube 20*a* that faces clearance portion 41*a* is shorter than the length, in the long side direction, of a portion thereof that is located at the leeward side relative to the foregoing portion and that faces fin 30, for example.

As shown in FIG. 3, in second airflow path region RP2, clearance portion 41*b* that separates between second heat transfer tube 20*b* and fin 30 is disposed to overlap with second imaginary line segment L1*b*. Clearance portion 41*b* has the same configuration as that of clearance portion 41*a*. From a different viewpoint, it can be said that second heat transfer tube 20*b* has the same configuration as that of first heat transfer tube 20*a* with regard to a relation with third heat transfer tube 20*c*. Two adjacent heat transfer tubes in the gravity direction among the plurality of heat transfer tubes of first heat exchanger 11 have the same configurations as those of first heat transfer tube 20*a* and second heat transfer tube 20*b*. In first heat exchanger 11 shown in FIG. 3 and FIG. 4, the number of clearance portions disposed in one fin 30 is equal to the number of heat transfer tubes.

In each of the plurality of fins 30, clearance portions 41*a*, 41*b* such as those shown in FIG. 3 are disposed when fin 30 is seen in a plan view. Clearance portion 41*a* of one fin 30 is disposed to overlap with a clearance portion 41*a* of another fin 30 in the y direction. In other words, respective ones of the plurality of clearance portions disposed in one fin 30 are disposed to overlap with respective ones of the clearance portions disposed in the other fin 30 in the y direction. That is, in first heat exchanger 11, a plurality of groups of clearance portions are provided to be separated from each other in the z direction with each of the groups being constituted of a plurality of clearance portions disposed to overlap in the y direction.

As shown in FIG. 5, each of first heat transfer tube 20*a* and second heat transfer tube 20*b* is joined to fin 30 via a brazing material 33, except for a region facing clearance portion 41*a* or clearance portion 41*b*. Fin 30 has fin collar portions 32 provided around the through holes of fin 30 in which first heat transfer tube 20*a* and second heat transfer tube 20*b* are inserted. Each of fin collar portions 32 has a structure obtained by bending fin 30 with respect to a main plate portion 31 thereof having a surface perpendicular to the y direction. Fin collar portions 32 are also provided at regions facing clearance portions 41*a*, 41*b*. Fin collar portions 32 not facing clearance portions 41*a*, 41*b* are in contact with first heat transfer tube 20*a* and second heat transfer tube 20*b*, and a fillet is formed therebetween by brazing material 33. Accordingly, first heat transfer tube 20*a* and second heat transfer tube 20*b* are joined to fin 30 by way of the metal. A close contact area (joining area) between fin 30 and each of first heat transfer tube 20*a* and second heat transfer tube 20*b* is provided to be wide by way of the metal joining with brazing material 33, whereby excellent heat transfer can be attained therebetween. That is, heat transfer from first heat transfer tube 20*a* to fin 30 located on the above-described imaginary line (for example, imaginary center line L2*a*) that is located at the leeward side relative to first imaginary line segment L1*a* and that does not overlap with clearance portion 41*a* is performed efficiently in the shortest path.

On the other hand, fin collar portions 32 facing clearance portions 41*a*, 41*b* are disposed to be separated from first heat transfer tube 20*a* and second heat transfer tube 20*b*. They are not joined via brazing material 33. That is, no brazing material 33 is provided in clearance portion 41*a* between first heat transfer tube 20*a* and fin collar portion 32 on first imaginary line segment L1*a*. In clearance portion 41*a*, portions of the upper flat surface and first surface of first heat transfer tube 20*a* are exposed. Hence, heat transfer from first heat transfer tube 20*a* to fin 30 located on first imaginary line segment L1*a* via the shortest path is inhibited by clearance portion 41*a*.

Clearance portions 41*a*, 41*b* can be formed by any method, but are formed simultaneously with the forming of fin collar portions 32, for example. Moreover, clearance portions 41*a*, 41*b* can be used as regions in which bar-like brazing materials are disposed, when joining first heat transfer tube 20*a* and second heat transfer tube 20*b* to the plurality of fins 30. The bar-like brazing materials are prepared to correspond to the number of the clearance portions disposed on one fin 30, for example. The length of each bar-like brazing material in the extending direction is equal to the length of first heat exchanger 11 in the y direction, for example. Each bar-like brazing material is provided to be insertable in a group of clearance portions disposed to be continuous in the y direction. After the bar-like brazing material is inserted in the group of clearance portions, the bar-like brazing material is heated and melted to be permeated into a portion located between heat transfer tube 20 and fin 30 and disposed to be continuous to each clearance portion, i.e., into fin collar portion 32. Then, the brazing material is cooled to be solidified, whereby heat transfer tube 20 and fin 30 are joined firmly as shown in FIG. 5.

<Operations of Air Conditioner and Outdoor Heat Exchanger>

Next, operations of refrigeration cycle apparatus 1 and outdoor heat exchanger 10 will be described. Refrigeration cycle apparatus 1 is provided to perform the cooling operation, the heating operation, and the defrosting operation. In refrigeration cycle apparatus 1, each of the cooling operation and the defrosting operation, and the heating operation are switched by switching the refrigerant circuit by four-way valve 7. It should be noted that in FIG. 1, a broken line arrow represents a flow direction of the refrigerant during the cooling operation and the defrosting operation, and a solid line arrow represents a flow direction of the refrigerant during the heating operation.

During the cooling operation of refrigeration cycle apparatus 1, a refrigerant circuit is formed in which compressor 2, outdoor heat exchanger 10, throttle device 5, and indoor heat exchanger 3 are connected in this order. High-temperature and high-pressure single-phase gas refrigerant discharged from compressor 2 flows, via four-way valve 7, into outdoor heat exchanger 10 functioning as a condenser. In outdoor heat exchanger 10, heat exchange is performed between the high-temperature high-pressure gas refrigerant thus having flowed thereinto and air supplied by outdoor fan 6, whereby the high-temperature high-pressure gas refrigerant is condensed into single-phase high-pressure liquid refrigerant. The high-pressure liquid refrigerant sent out from outdoor heat exchanger 10 is formed, by throttle device 5, into two-phase state refrigerant including low-pressure gas refrigerant and liquid refrigerant. The two-phase state refrigerant flows into indoor heat exchanger 3 functioning as an evaporator. In indoor heat exchanger 3, heat exchange is performed between the two-phase state refrigerant thus having flowed thereinto and air supplied by indoor fan 4, whereby the liquid refrigerant of the two-phase state refrigerant is evaporated into single-phase low-pressure gas refrigerant. With this heat exchange, inside of a room is cooled. The low-pressure gas refrigerant sent out from indoor heat exchanger 3 flows into compressor 2 via four-way valve 7, is compressed into high-temperature high-pressure gas refrigerant, and is discharged again from compressor 2. Thereafter, this cycle is repeated.

During the heating operation of refrigeration cycle apparatus 1, a refrigerant circuit is formed in which compressor 2, indoor heat exchanger 3, throttle device 5, and outdoor heat exchanger 10 are connected in this order. High-temperature and high-pressure single-phase gas refrigerant discharged from compressor 2 flows, via four-way valve 7, into indoor heat exchanger 3 functioning as a condenser. In indoor heat exchanger 3, heat exchange is performed between the high-temperature high-pressure gas refrigerant thus having flowed thereinto and air supplied by indoor fan 4, whereby the high-temperature high-pressure gas refrigerant is condensed into single-phase high-pressure liquid refrigerant. With this heat exchange, inside of a room is heated. The high-pressure liquid refrigerant sent out from indoor heat exchanger 3 is formed, by throttle device 5, into two-phase state refrigerant including low-pressure gas refrigerant and liquid refrigerant. The two-phase state refrigerant flows into outdoor heat exchanger 10 functioning as an evaporator. In outdoor heat exchanger 10, heat exchange is performed between the two-phase state refrigerant thus having flowed thereinto and air supplied by outdoor fan 6, whereby the liquid refrigerant of the two-phase state refrigerant is evaporated into single-phase low-pressure gas refrigerant.

The low-pressure gas refrigerant sent out from outdoor heat exchanger 10 flows into compressor 2 via four-way valve 7, is compressed into high-temperature high-pressure gas refrigerant, and is discharged again from compressor 2. Thereafter, this cycle is repeated.

During the heating operation, a water content included in outdoor air is condensed by outdoor heat exchanger 10 functioning as an evaporator, whereby condensed water is generated on surfaces of the plurality of heat transfer tubes 20 and the plurality of plate-like fins 30. The condensed water falls down via the surfaces of heat transfer tubes 20 and fins 30, and is discharged to below the evaporator as drain water. Here, each of the plurality of heat transfer tubes 20 is inclined downward in the gravity direction from the windward side to the leeward side in the flow direction. Hence, the condensed water having reached the surfaces of heat transfer tubes 20 are efficiently discharged from outdoor heat exchanger 10. Furthermore, outdoor heat exchanger 10 has a high frost formation resistance (details will be described later).

However, part of the condensed water may become frost and the frost may be adhered to outdoor heat exchanger 10. The frost adhered to outdoor heat exchanger 10 inhibits heat exchange between the refrigerant and the outdoor air, with the result that the heating efficiency of refrigeration cycle apparatus 1 is decreased. Hence, refrigeration cycle apparatus 1 is provided to perform the defrosting operation for melting the frost adhered to outdoor heat exchanger 10.

During the defrosting operation of refrigeration cycle apparatus 1, the same refrigerant circuit as that during the cooling operation is formed. The refrigerant compressed in compressor 2 is sent to outdoor heat exchanger 10 to heat and melt the frost adhered to outdoor heat exchanger 10. Accordingly, the frost adhered to outdoor heat exchanger 10 during the heating operation is melted into water by the defrosting operation. The melt water is effectively discharged from outdoor heat exchanger 10. It should be noted that during the defrosting operation, indoor fan 4 and outdoor fan 6 are made non-operational, for example.

<Function and Effect>

Figure 6:
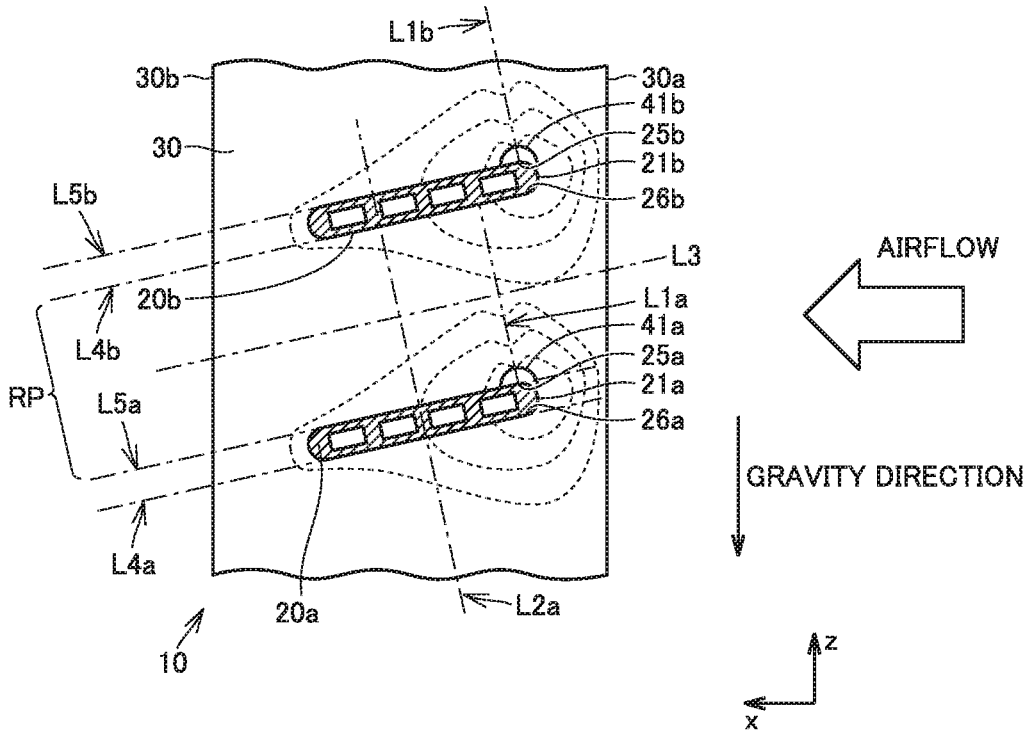
FIG. 6 is a partial cross sectional view showing a heat flux distribution of the heat exchanger shown in FIG. 3.
Figure 7:
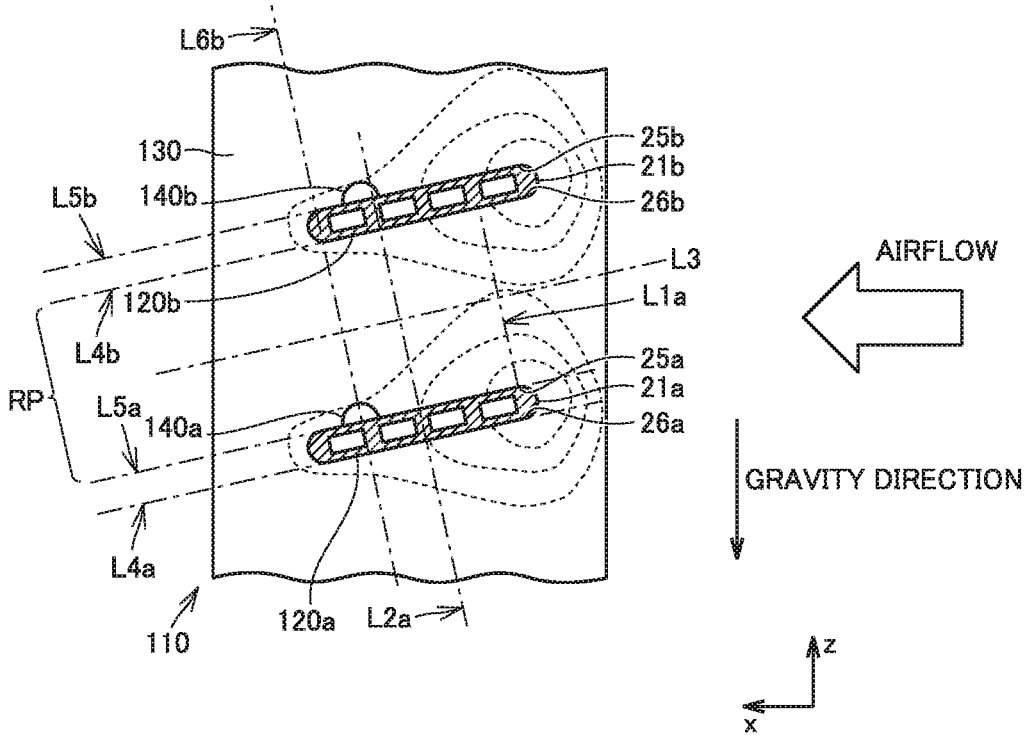
FIG. 7 is a partial cross sectional view showing a heat flux distribution of a comparative example.

Next, with reference to FIG. 6 and FIG. 7, the following describes function and effect of heat exchanger 10 based on a comparison with a comparative example. FIG. 6 is a partial enlarged view showing the configuration of heat exchanger 10 and a heat flux distribution representing an amount of exchanged heat per unit area on fin 30. FIG. 7 is a partial enlarged view showing a configuration of the comparative example and a heat flux distribution representing an amount of exchanged heat per unit area on a fin 130. Each of annular point lines shown in FIG. 6 and FIG. 7 indicates a heat flux contour line representing the amount of exchanged heat per unit area on the fin. It should be noted that since there is generally a correlation between heat transfer and mass transfer, it is considered that the heat flux has a correlation with an amount of mass transfer per unit area, i.e., mass flux indicating a local frost formation amount.

The heat exchanger of the comparative example shown in FIG. 7 is different from heat exchanger 10 in terms of the configuration of the clearance portion. In the comparative example, a clearance portion 140*a* that separates between a first heat transfer tube 120*a* and fin 30 is disposed to face an airflow path region between first heat transfer tube 120*a* and a second heat transfer tube 120*b*. Clearance portion 140*a* is disposed at the leeward side relative to imaginary center line L2*a* that passes through the center of first heat transfer tube 120*a* in the long side direction and that extends along the short side direction. Clearance portion 140*a* is provided as part of a discharge path for condensed water.

When the heat exchanger of the comparative example is operated as an evaporator, the temperature of the refrigerant serving as a target heat exchanging fluid is lower than the temperature of the air serving as a heat exchanging fluid. Therefore, the surface temperature of heat transfer tube 120*a* in which the refrigerant flows is lower than the surface temperature of fin 130 in the airflow path region through which the air flows. Since heat transfer between heat transfer tube 120*a* and fin 130 is performed from fin 130 to heat transfer tube 120*a*, the surface temperature of fin 130 indicates a distribution according to a distance between fin 130 and heat transfer tube 120*a*. Moreover, when flowing from the windward side to the leeward side via heat transfer tube 130 in which the refrigerant serving as a target heat exchanging fluid flows, the air is cooled and the water content in the air is condensed. Hence, the temperature and absolute humidity of the air supplied to the windward side in the fin and tube type heat exchanger is higher than the temperature and absolute humidity of the air passing at the leeward side.

By taking the above surface temperature distribution and the temperature and humidity distribution of the air into consideration, a heat flux (mass flux) distribution shown in FIG. 7 is found. In the comparative example shown in FIG. 7, first heat transfer tube 120*a* and fin 130 located at the windward side relative to imaginary center line L2*a* are connected in the shortest distance. Therefore, in the region located at the windward side relative to imaginary center line L2*a*, the heat flux contour line is disposed more densely and more widely from one of first heat transfer tube 120*a* and second heat transfer tube 120*b* to the other than that in the region located at the leeward side relative to imaginary center line L2*a*. Therefore, in the comparative example, a temperature difference between fin 130 and the air in the whole of the region located at the windward side relative to imaginary center line L2*a* and including imaginary line L3 becomes large to such an extent that frost is formed.

Particularly, on imaginary line L3, the temperature difference between fin 130 and the air is the maximum on first imaginary line segment L1*a*, i.e., the temperature difference therebetween is the maximum on an intersection between first imaginary line segment L1*a* and imaginary line L3. This is due to the following reason: fin 130 on the intersection is connected to first heat transfer tube 120*a* and second heat transfer tube 120*b* in the shortest distance and is therefore sufficiently cooled, whereas air having a comparatively high temperature is supplied onto the intersection to result in a large temperature difference between fin 130 and the air on the intersection.

Hence, in the comparative example, frost is likely to be formed also on imaginary line L3, with the result that airflow path region RP is likely to be blocked by the frost. Clearance portion 140*a* cannot sufficiently suppress such blocking. This makes it difficult for the heat exchanger of the comparative example to exhibit sufficient evaporation performance during the heating operation, thus resulting in decreased performance (heating performance) at the indoor unit side.

On the other hand, as shown in FIG. 6, heat exchanger 10 includes: plate-like fin 30; and first heat transfer tube 20*a* and second heat transfer tube 20*b* that each extend through fin 30 and that are adjacent to each other in the gravity direction. In the cross section perpendicular to the first direction in which first heat transfer tube 20*a* and second heat transfer tube 20*b* extend, the outer shape of each of first heat transfer tube 20*a* and second heat transfer tube 20*b* is a flat shape. First heat transfer tube 20*a* is disposed below second heat transfer tube 20*b*. The portion to which fin 30 and first heat transfer tube 20*a* are connected, and clearance portion 41*a* that separates between fin 30 and first heat transfer tube 20*a* are disposed between first heat transfer tube 20*a* and fin 30. Clearance portion 41*a* is disposed at the windward side in the flowing direction relative to imaginary center line L2*a* that passes through the center of first heat transfer tube 20*a* in the long side direction and that extends along the short side direction.

In heat exchanger 10 shown in FIG. 6, portions of first heat transfer tube 20*a* and fin 30 located at the windward side relative to imaginary center line L2*a* are connected to each other with clearance portion 41*a* being interposed therebetween, and the other portions thereof are connected directly to each other without clearance portion 41*a* being interposed therebetween. Therefore, a heat path between first heat transfer tube 20*a* and fin 30 connected to each other with clearance portion 41*a* being interposed therebetween becomes longer than a heat path between first heat transfer tube 20*a* and fin 30 connected directly to each other without clearance portion 41*a* being interposed therebetween. As a result, the heat flux contour line shown in FIG. 6 is depressed toward the first heat transfer tube 20*a* side at a region of fin 30 overlapping, in the short side direction, with clearance portion 41*a* disposed at the windward side relative to imaginary center line L2*a*. That is, according to heat exchanger 10, the temperature of fin 30 located at the windward side relative to imaginary center line L2*a* during its operation as an evaporator, particularly, the temperature of fin 30 overlapping with clearance portion 41*a* in the short side direction and located on imaginary line L3 can be higher than that in the comparative example. Accordingly, in heat exchanger 10, frost formation in airflow path region RP, particularly, frost formation on imaginary line L3 can be suppressed as compared with the comparative example. Hence, airflow path region RP can be suppressed from being blocked by the frost. As a result, heat exchanger 10 can exhibit sufficient evaporation performance during the heating operation, whereby performance (heating performance) at the indoor unit side can be suppressed from being decreased.

Further, in clearance portion 41*a* of heat exchanger 10, portions of the upper flat surface and first surface of first heat transfer tube 20*a* are exposed. Accordingly, according to heat exchanger 10, during its operation as an evaporator, frost can be intensively generated on the surfaces of first heat transfer tube 20*a* exposed in clearance portion 41*a*, whereby the flow path for the heat exchanging fluid can be suppressed more effectively from being blocked by frost.

Further, first heat transfer tube 20*a* and second heat transfer tube 20*b* are inclined such that leeward side end portions 22*a*. 22*b* are located at the lower side relative to windward side end portions 21*a*. 21*b* in the z direction. Accordingly, according to heat exchanger 10, for example, even when no air is supplied from outdoor fan 6 shown in FIG. 1 during the defrosting operation, water droplets adhered on the surfaces of first heat transfer tube 20*a* and second heat transfer tube 20*b* flow out to the leeward side due to gravity, and are discharged via the leeward region.

Accordingly, heat exchanger 10 has a high water discharging characteristic.

In heat exchanger 10, clearance portion 41*a* is disposed to overlap with the first imaginary line segment that connects between first heat transfer tube 20*a* and second heat transfer tube 20*b* in the shortest distance and that is drawn at the most windward side in the flowing direction.

Therefore, fin 30 and first boundary portion 25*a* of first heat transfer tube 20*a* located on first imaginary line segment L1*a* are connected with clearance portion 41*a* being interposed therebetween, and are therefore not connected to each other in the shortest distance. That is, heat transfer from first heat transfer tube 20*a* to fin 30 located on first imaginary line segment L1*a* is inhibited from being performed via the shortest path, by clearance portion 41*a* disposed to overlap with first imaginary line segment L1*a*. Accordingly, according to heat exchanger 10, the temperature of fin 30 located on first imaginary line segment L1*a* during its operation as an evaporator, such as the temperature of fin 30 located on the intersection between first imaginary line segment L1*a* and imaginary line L3, can be higher than that in the comparative example. As a result, in heat exchanger 10, as compared with the comparative example, the flow path for the heat exchanging fluid can be suppressed effectively from being blocked by frost.

In heat exchanger 10, the width of fin 30 on first imaginary line segment L1*a* is shorter than the width of fin 30 on imaginary center line L2*a* that connects between first heat transfer tube 20*a* and second heat transfer tube 20*b* in the shortest distance and that passes through the center of first heat transfer tube 20*a*. Fin 30 facing airflow path region RP and located at least on imaginary center line L2*a* is connected to first heat transfer tube 20*a* in the shortest distance. Accordingly, heat can be efficiently exchanged with first heat transfer tube 20*a*. That is, according to heat exchanger 10, sufficient heat exchanging performance can be secured while effectively suppressing the flow path for the heat exchanging fluid from being blocked by frost during its operation as an evaporator as compared with the conventional heat exchanger.

In heat exchanger 10, the width of clearance portion 41*a* in the direction along first imaginary line segment L1*a* is the maximum on first imaginary line segment L1*a*.

In this way, heat exchange between fin 30 and first heat transfer tube 20*a* on the region not overlapping with first imaginary line segment L a is not greatly inhibited by clearance portion 41*a*. Therefore, according to heat exchanger 10, sufficient heat exchanging performance can be secured while effectively suppressing the flow path for the heat exchanging fluid from being blocked by frost during its operation as an evaporator as compared with the conventional heat exchanger.

Each of first heat transfer tube 20*a* and second heat transfer tube 20*b* of heat exchanger 10 has: the upper flat surface and lower flat surface disposed in parallel to be separated from each other in the short side direction in the cross section; and the first surface and second surface, the first surface connecting the upper flat surface to the lower flat surface at the windward side, the second surface connecting the upper flat surface to the lower flat surface at the leeward side in the flowing direction. First imaginary line segment L1*a* passes through first boundary portion 25*a* between the upper flat surface and first surface of first heat transfer tube 20*a*. Clearance portion 41*a* faces the upper flat surface and first surface of first heat transfer tube 20*a*.

In this way, in a method for manufacturing heat exchanger 10, when clearance portion 41*a* is used as an insertion portion for the bar-like brazing material, the melted brazing material can be spread widely via the upper flat surface and can be spread widely via the first surface. As a result, a fillet can be uniformly formed using brazing material 33 around first heat transfer tube 20*a*.

Refrigeration cycle apparatus 1 includes: heat exchanger 10; and fan 6 configured to blow the heat exchanging fluid to heat exchanger 10. In such a refrigeration cycle apparatus 1, when heat exchanger 10 is used as an evaporator, heat exchanger 10 can exhibit high evaporation performance as described above. Hence, higher heating performance can be exhibited than that in a refrigeration cycle apparatus including the heat exchanger of the comparative example.

From a viewpoint that does not take into consideration a manner in which heat exchanger 10 is disposed within refrigeration cycle apparatus 1, it can be said that the first end portion (windward side end portion 21*a*) of first heat transfer tube 20*a* located at the one end 30*a* side of fin 30 in the x direction is disposed at the one side in the z direction relative to the second end portion (leeward side end portion 22*a*) of first heat transfer tube 20*a* located at the other end 30*b* side of fin 30 in the x direction. The third end portion (windward side end portion 21*b*) of second heat transfer tube 20*b* located at the one end 30*a* side in the x direction is disposed at the one side in the z direction relative to the fourth end portion (leeward side end portion 22*b*) located at the other end 30*b* side of fin 30 in the x direction. The distance in the z direction between the first end portion (windward side end portion 21*a*) of first heat transfer tube 20*a* and the fourth end portion (leeward side end portion 22*b*) of second heat transfer tube 20*b* is shorter than the distance in the z direction between the second end portion (leeward side end portion 22*a*) of first heat transfer tube 20*a* and the third end portion (windward side end portion 21*b*) of second heat transfer tube 20*b*. In the x direction, clearance portion 41*a* is disposed at the one end 30*a* side relative to imaginary center line L2*a* that passes through the center of first heat transfer tube 20*a* in the long side direction and that extends along the short side direction.

As described above, heat exchanger 10 serving as an outdoor heat exchanger in refrigeration cycle apparatus 1 is disposed such that: the x direction is along the direction of flow of the heat exchanging fluid caused by outdoor fan 6; one end 30*a* of fin 30 in the x direction is disposed at the windward side of the heat exchanging fluid, and the z direction is along the gravity direction. Accordingly, the first end portion of first heat transfer tube 20*a* and the third end portion of second heat transfer tube 20*b* are disposed at the windward side and serve as windward side end portions 21*a*, 21*b*, and the second end portion of first heat transfer tube 20*a* and the fourth end portion of second heat transfer tube 20*b* are disposed at the leeward side, and serve as leeward side end portions 22*a*, 22*b*. Further, first heat transfer tube 20*a* is disposed below second heat transfer tube 20*b*.

Second Embodiment

Figure 8:
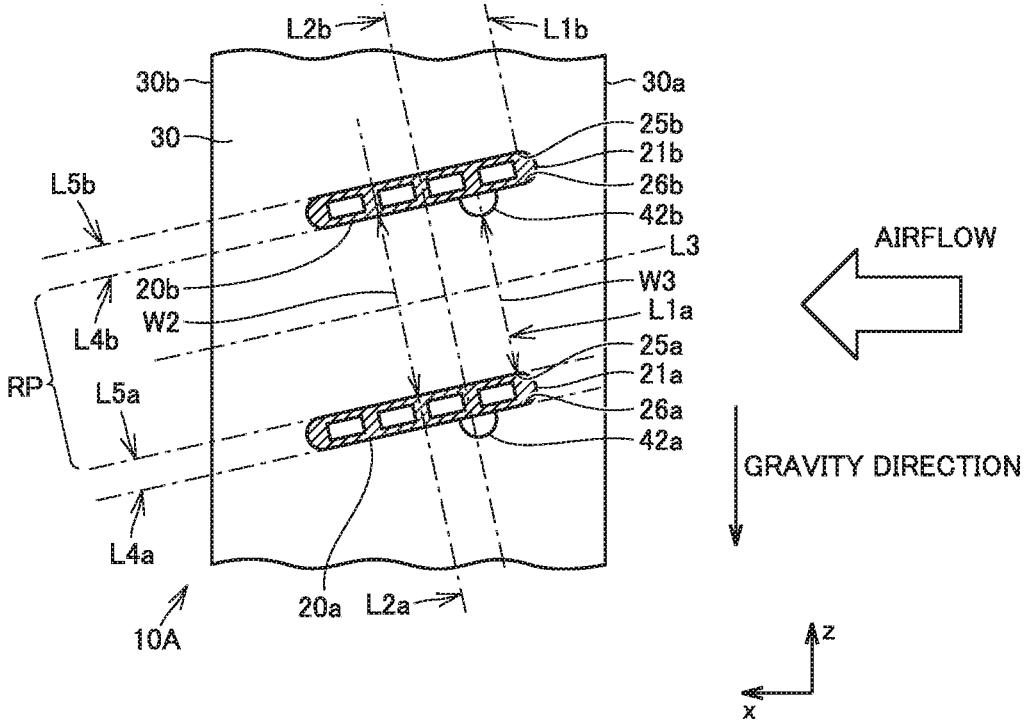
FIG. 8 is a partial cross sectional view of a heat exchanger according to a second embodiment.

As shown in FIG. 8, a heat exchanger 10A according to a second embodiment includes basically the same configuration as that of heat exchanger 10 according to the first embodiment, but is different therefrom in that a clearance portion 42*b* provided to face airflow path region RP faces the lower flat surface of second heat transfer tube 20*b*.

Clearance portion 42*b* faces only the lower flat surface of the surfaces of second heat transfer tube 20*b*, for example. Clearance portion 42*b* does not face the first surface of second heat transfer tube 20*b*, for example. Although clearance portion 42*b* may have any planar shape when seen in the y direction, clearance portion 42*b* has a sector shape centering on a portion of second heat transfer tube 20*b* located on first imaginary line segment L1*a* as shown in FIG. 8, for example. Clearance portion 42*b* is provided in line symmetry with respect to first imaginary line segment L1*a* in the long side direction, for example.

As shown in FIG. 8, since clearance portion 42*b* is disposed, width W3 of fin 30 on first imaginary line segment L1*a* is shorter than width W2 of fin 30 on any imaginary line that connects between first heat transfer tube 20*a* and second heat transfer tube 20*b* in the shortest distance without clearance portion 42*b* being interposed therebetween in first region R1, such as imaginary center line L2*a*.

A clearance portion 42*a* facing the lower flat surface of first heat transfer tube 20*a* includes the same configuration as that of clearance portion 42*b*. Clearance portion 42*a* is disposed at the windward side relative to an imaginary center line of another heat transfer tube (not shown) disposed adjacent to first heat transfer tube 20*a* at a lower position in the gravity direction, and is disposed to overlap with a first imaginary line in the other heat transfer tube. Clearance portion 42*a* is disposed at the windward side relative to imaginary center line L2*a* of first heat transfer tube 20*a*, for example. Clearance portion 42*a* is disposed to overlap with imaginary center line L2*b* of second heat transfer tube 20*b*, for example.

According to such a heat exchanger 10A, clearance portion 42*b* is disposed at the windward side relative to imaginary center line L2*a* in airflow path region RP, and is also disposed to overlap with first imaginary line segment L1*a*. Hence, the same effect as that of heat exchanger 10 can be exhibited. That is, in heat exchanger 10A, as compared with the comparative example shown in FIG. 7, the flow path for the heat exchanging fluid can be suppressed effectively from being blocked by frost.

Third Embodiment

Figure 9:
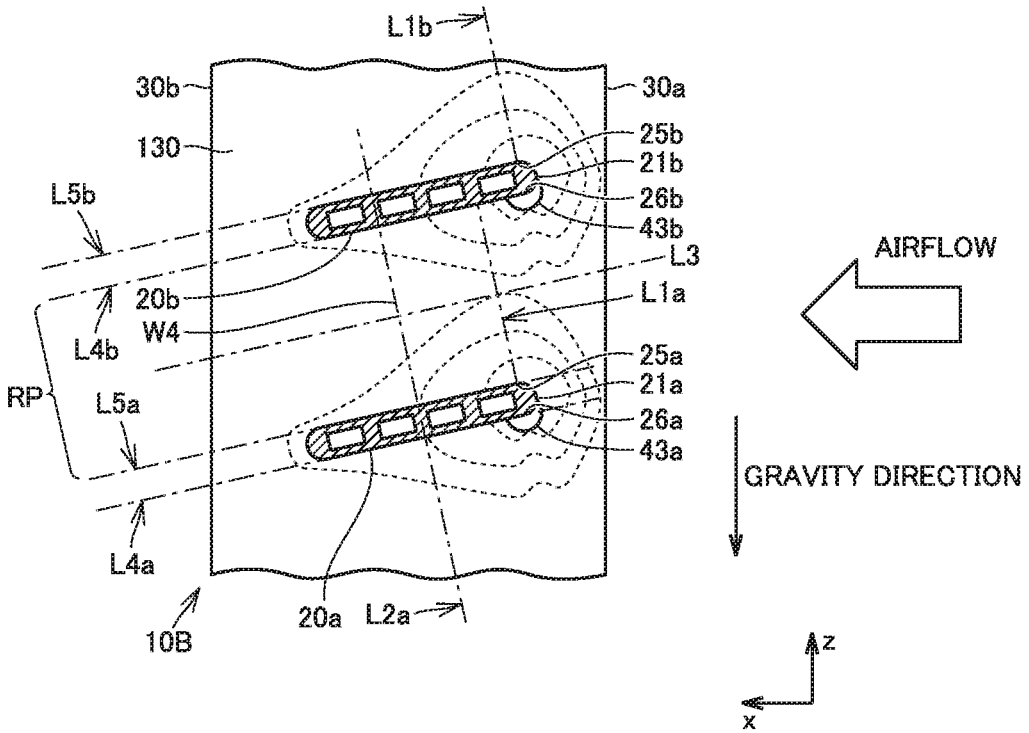
FIG. 9 is a partial cross sectional view of a heat exchanger according to a third embodiment.

As shown in FIG. 9, a heat exchanger 10B according to a third embodiment includes basically the same configuration as those of heat exchanger 10 according to the first embodiment and heat exchanger 10A according to the second embodiment, but is different therefrom in that a clearance portion 43*b* provided to face airflow path region RP is not disposed to overlap with first imaginary line segment L1*a* and is disposed at the windward side relative to first imaginary line segment L1*a*.

Clearance portion 43*b* is disposed to overlap with second imaginary line segment L1*b*, for example. Clearance portion 43*b* faces the lower flat surface of second heat transfer tube 20*b* and the first surface of second heat transfer tube 20*b*, for example. Although clearance portion 43*b* may have any planar shape when seen in the y direction, clearance portion 43*b* has a sector shape centering on a portion of second heat transfer tube 20*b* located on first imaginary line segment L1*a*, i.e., fourth boundary portion 26*b* as shown in FIG. 9, for example.

A clearance portion 43*a* facing the lower flat surface of first heat transfer tube 20*a* includes the same configuration as that of clearance portion 43*b*. Clearance portion 43*a* is disposed at the windward side relative to a first imaginary center line of another heat transfer tube (not shown) disposed adjacent to first heat transfer tube 20*a* at a lower position in the gravity direction, and is disposed to overlap with a first imaginary line segment L1*a* of first heat transfer tube 20*a*.

According to such a heat exchanger 10B, clearance portion 43*b* is disposed at the windward side relative to imaginary center line L2*a* in airflow path region RP, and is also disposed to overlap with first imaginary line segment L1*a*. Hence, the same effect as that of heat exchanger 10 can be exhibited. That is, in heat exchanger 10B, as compared with the comparative example shown in FIG. 7, the flow path for the heat exchanging fluid can be suppressed effectively from being blocked by frost.

Fourth Embodiment

Figure 10:
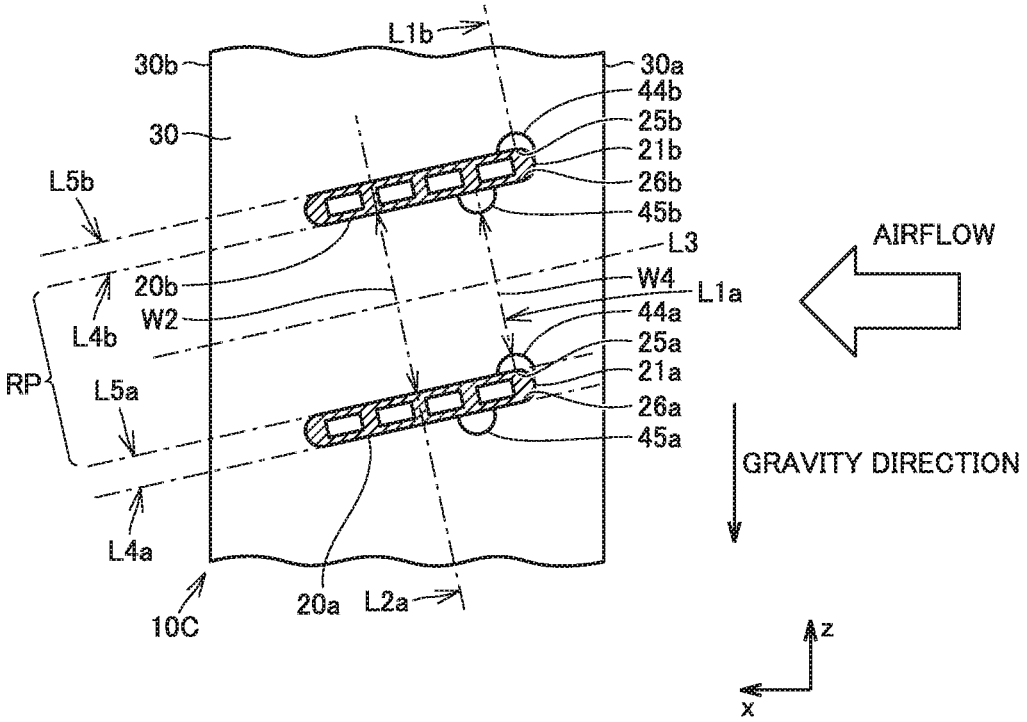
FIG. 10 is a partial cross sectional view of a heat exchanger according to a fourth embodiment.

As shown in FIG. 10, a heat exchanger 10C according to a fourth embodiment includes basically the same configuration as that of heat exchanger 10 according to the first embodiment, but is different therefrom in that a plurality of clearance portions (a first clearance portion 44*a* and a second clearance portion 45*b*) are disposed in one airflow path region RP.

The plurality of clearance portions include: first clearance portion 44*a* that faces the upper flat surface of first heat transfer tube 20*a*; and second clearance portion 45*b* that is disposed to be separated from first clearance portion 44*a* in the short side direction and that faces the lower flat surface of second heat transfer tube 20*b*.

First clearance portion 44*a* includes the same configuration as that of clearance portion 41*a* shown in FIG. 3. Second clearance portion 45*b* includes the same configuration as that of clearance portion 42*b* shown in FIG. 8. First clearance portion 44*a* and second clearance portion 45*b* are disposed to be separated from each other in the short side direction. First clearance portion 44*a* and second clearance portion 45*b* are disposed to overlap with first imaginary line segment L1*a*.

As shown in FIG. 10, since clearance portion 41*a* is disposed, width W4 of fin 30 on first imaginary line segment L1*a* is shorter than width W2 of fin 30 on any imaginary line that connects between first heat transfer tube 20*a* and second heat transfer tube 20*b* in the shortest distance without first clearance portion 44*a* and second clearance portion 45*b* being interposed therebetween in first region R1, such as imaginary center line L2*a*. Width W4 is shorter than width W1 in heat exchanger 10 shown in FIG. 3 by the width of second clearance portion 45*b* in the short side direction.

Moreover, width W4 is shorter than width W3 in heat exchanger 10 shown in FIG. 8 by the width of first clearance portion 44*a* in the short side direction. Fin 30 on the intersection between first imaginary line segment L1*a* and imaginary line L3 is connected to first heat transfer tube 20*a* with first clearance portion 44*a* being interposed therebetween, and is connected to second heat transfer tube 20*b* with second clearance portion 45*b* being interposed therebetween.

In another airflow path region adjacent to airflow path region RP with first heat transfer tube 20*a* being interposed therebetween, a second clearance portion 45*a* facing the lower flat surface of first heat transfer tube 20*a* is disposed. As shown in FIG. 10, first clearance portion 44*a* facing the upper flat surface of first heat transfer tube 20*a* and second clearance portion 45*a* facing the lower flat surface of first heat transfer tube 20*a* are disposed not to overlap with each other in the short side direction, for example. It should be noted that respective portions of first clearance portion 44*a* and second clearance portion 45*a* may be disposed to overlap with each other in the short side direction.

Clearance portion 44*b* includes the same configuration as that of clearance portion 41*b* shown in FIG. 3. Clearance portion 45*a* includes the same configuration as that of clearance portion 42*a* shown in FIG. 8.

According to such a heat exchanger 10C, since first clearance portions 44*a*, 44*b* including the same configurations as those of clearance portions 41*a*, 41*b* of heat exchanger 10 and clearance portions 45*a*, 45*b* including the same configurations as those of clearance portions 42*a*, 42*b* of heat exchanger 10A are provided, the same effects as those of heat exchanger 10 and heat exchanger 10A can be exhibited.

Further, according to heat exchanger 10C, fin 30 on the intersection between first imaginary line segment L1*a* and imaginary line L3 is connected to first heat transfer tube 20*a* with first clearance portion 44*a* being interposed therebetween, and is connected to second heat transfer tube 20*b* with second clearance portion 45*b* being interposed therebetween. Accordingly, according to heat exchanger 10C, frost can be suppressed from being adhered to fin 30 on the intersection as compared with heat exchangers 10, 10A, whereby the flow path for the heat exchanging fluid can be suppressed more effectively from being blocked by frost.

Although the embodiments of the present invention have been illustrated as described above, the above-described embodiments can be modified in various manners.

Moreover, the scope of the present invention is not limited to the above-described embodiments. The scope of the present invention is defined by the terms of the claims, and is intended to include any modifications within the scope and meaning equivalent to the terms of the claims.

The invention claimed is:

1. A heat exchanger comprising:

a plate-like fin having a windward end and a leeward end in a first direction which is along a flow direction of a heat exchanging fluid; and a first heat transfer tube and a second heat transfer tube that each extend through the plate-like fin and that are adjacent to each other in a second direction which is along a gravity direction and crossing the first direction, wherein an outer shape of each of the first heat transfer tube and the second heat transfer tube in a cross section perpendicular to an extending direction of each of the first heat transfer tube and the second heat transfer tube is a flat shape having a long side direction and a short side direction, a first end portion of the first heat transfer tube located at the windward end is disposed at an upper side in the second direction relative to a second end portion of the first heat transfer tube located at the leeward end, a third end portion of the second heat transfer tube located at the windward end is disposed at the upper side in the second direction relative to a fourth end portion of the second heat transfer tube located at the leeward end, a portion to which the plate-like fin and at least one of the first heat transfer tube and the second heat transfer tube are connected, and at least one clearance portion that separates between the plate-like fin and the at least one of the first heat transfer tube and the second heat transfer tube are disposed between the plate-like fin and the at least one of the first heat transfer tube and the second heat transfer tube, the at least one clearance portion is disposed at the windward end in the first direction relative to an imaginary center line that passes through a center of the first heat transfer tube in the long side direction and that extends along the short side direction, and wherein the at least one clearance portion is disposed to overlap with a first imaginary line segment that connects between the first heat transfer tube and the second heat transfer tube in a shortest distance and that is drawn at the most windward end in the first direction.

2. The heat exchanger according to claim 1, wherein a width of the plate-like fin on the first imaginary line segment is shorter than a width of the plate-like fin on the imaginary center line.

3. The heat exchanger according to claim 2, wherein a width of the clearance portion in a direction along the first imaginary line segment is the maximum on the first imaginary line segment.

4. The heat exchanger according to claim 1, wherein each of the first heat transfer tube and the second heat transfer tube has an upper flat surface and a lower flat surface disposed in parallel to be separated from each other in the short side direction, and a first surface and a second surface, the first surface connecting the upper flat surface to the lower flat surface at the windward end and facing the windward end, the second surface connecting the upper flat surface to the lower flat surface at the leeward end and facing the leeward end, and the first imaginary line segment passes through a boundary portion between the upper flat surface and the first surface of the first heat transfer tube.

5. The heat exchanger according to claim 4, wherein the at least one clearance portion has a first clearance portion which faces the upper flat surface of the first heat transfer tube.

6. The heat exchanger according to claim 4, wherein the at least one clearance portion has a second clearance portion which faces the lower flat surface of the second heat transfer tube.

7. The heat exchanger according to claim 5, wherein the at least one clearance portion is constituted of a plurality of the clearance portions, the plurality of clearance portions include the first clearance portion, and a second clearance portion that is disposed to be separated from the first clearance portion in a direction along the first imaginary line segment, and that faces the lower flat surface of the second heat transfer tube.

8. The heat exchanger according to claim 1, wherein a distance in the second direction between the first end portion of the first heat transfer tube and the fourth end portion of the second heat transfer tube is shorter than a distance in the second direction between the second end portion of the first heat transfer tube and the third end portion of the second heat transfer tube.

9. The heat exchanger according to claim 2, wherein each of the first heat transfer tube and the second heat transfer tube has an upper flat surface and a lower flat surface disposed in parallel to be separated from each other in the short side direction, and a first surface and a second surface, the first surface connecting the upper flat surface to the lower flat surface at the windward end, the second surface connecting the upper flat surface to the lower flat surface at the leeward end, and the first imaginary line segment passes through a boundary portion between the upper flat surface and the first surface of the first heat transfer tube.

10. The heat exchanger according to claim 9, wherein the at least one clearance portion faces the upper flat surface of the first heat transfer tube.

11. The heat exchanger according to claim 9, wherein the at least one clearance portion faces the lower flat surface of the second heat transfer tube.

12. The heat exchanger according to claim 3, wherein each of the first heat transfer tube and the second heat transfer tube has an upper flat surface and a lower flat surface disposed in parallel to be separated from each other in the short side direction, and a first surface and a second surface, the first surface connecting the upper flat surface to the lower flat surface at the windward end, the second surface connecting the upper flat surface to the lower flat surface at the leeward end, and the first imaginary line segment passes through a boundary portion between the upper flat surface and the first surface of the first heat transfer tube.

13. The heat exchanger according to claim 12, wherein the at least one clearance portion faces the upper flat surface of the first heat transfer tube.

14. The heat exchanger according to claim 12, wherein the at least one clearance portion faces the lower flat surface of the second heat transfer tube.

15. The heat exchanger according to claim 5, wherein the at least one clearance portion faces the lower flat surface of the second heat transfer tube.

16. The heat exchanger according to claim 6, wherein the second clearance portion is disposed to be separated from the first clearance portion in a direction along the first imaginary line segment, and faces the lower flat surface of the second heat transfer tube.

17. The heat exchanger according to claim 1, wherein the at least one clearance portion is formed as a through hole extending through fin in a third direction that is perpendicular to both the first direction and the second direction.

18. The heat exchanger according to claim 1, wherein the at least one clearance portion is configured as a portion that is depressed with respect to a plane perpendicular to a third direction, the third direction being perpendicular to both the first direction and the second direction.

19. A refrigeration cycle apparatus comprising:

a heat exchanger comprising:

a plate-like fin having a windward end and a leeward end in a first direction which is along a flow direction of a heat exchanging fluid; and a first heat transfer tube and a second heat transfer tube that each extend through the plate-like fin and that are adjacent to each other in a second direction which is along a gravity direction and crossing the first direction, wherein an outer shape of each of the first heat transfer tube and the second heat transfer tube in a cross section perpendicular to an extending direction of each of the first heat transfer tube and the second heat transfer tube is a flat shape having a long side direction and a short side direction, a first end portion of the first heat transfer tube located at the windward end is disposed at an upper side in the second direction relative to a second end portion of the first heat transfer tube located at the leeward end, a third end portion of the second heat transfer tube located at the windward end is disposed at the upper side in the second direction relative to a fourth end portion of the second heat transfer tube located at the leeward end, a portion to which the plate-like fin and at least one of the first heat transfer tube and the second heat transfer tube are connected, and at least one clearance portion that separates between the plate-like fin and the at least one of the first heat transfer tube and the second heat transfer tube are disposed between the plate-like fin and the at least one of the first heat transfer tube and the second heat transfer tube, the at least one clearance portion is disposed at the windward end in the first direction relative to an imaginary center line that passes through a center of the first heat transfer tube in the long side direction and that extends along the short side direction, and wherein the at least one clearance portion is disposed to overlap with a first imaginary line segment that connects between the first heat transfer tube and the second heat transfer tube in a shortest distance and that is drawn at the most windward end in the first direction; and a fan configured to blow a heat exchanging fluid to the heat exchanger along the first direction, wherein the heat exchanger is disposed such that the one end of the plate-like fin is located at the windward end of the heat exchanging fluid and the second direction is along a gravity direction.

* * * * *